US006159029A

United States Patent [19]

Burwell et al.

[11] Patent Number: 6,159,029

[45] Date of Patent: Dec. 12, 2000

[54] FLUORESCENT LAMP HOLDER

[75] Inventors: John W. Burwell, Rome City; James M. Gust, Wolcottville; Robert E. Bolen, Kendallville, all of Ind.

[73] Assignee: Lyall Assemblies, Inc., Albion, Ind.

[21] Appl. No.: 08/910,319

[22] Filed: Aug. 13, 1997

Related U.S. Application Data

[63] Continuation-in-part of application No. 08/551,897, Oct. 23, 1995, Pat. No. 5,688,139.

[51] Int. Cl.[7] ..... H01R 33/02

[52] U.S. Cl. ..... 439/241

[58] Field of Search ..... 439/226–229, 439/236, 339–244, 159

[56] References Cited

U.S. PATENT DOCUMENTS

| | | | |
|---|---|---|---|
| 2,282,875 | 5/1942 | Mueller | 173/328 |
| 2,284,376 | 5/1942 | De Reamer et al. | 173/328 |
| 2,297,738 | 10/1942 | Beal | 439/241 |
| 2,339,751 | 1/1944 | Beal | 173/328 |
| 2,575,597 | 11/1951 | Semeyn | 439/241 |
| 2,616,943 | 11/1952 | Van Werd et al. | 173/328 |
| 2,623,088 | 12/1952 | Axberg | 173/328 |
| 2,769,152 | 10/1956 | Fortin | 439/241 |
| 3,596,227 | 7/1971 | Shea | 439/241 |
| 3,781,759 | 12/1973 | Shelly, Jr. | 339/54 |
| 4,565,415 | 1/1986 | Feinberg | 439/241 |

*Primary Examiner*—Hien Vu
*Attorney, Agent, or Firm*—Taylor & Aust, P.C.

[57] ABSTRACT

A lamp holder carries a fluorescent lamp which includes first and second contact pins, with each contact pin having a diameter. The lamp holder includes a socket having a pair of walls defining a clearance distance therebetween which is at all times greater than the diameter of the contact pins. The walls define a slot therebetween, the slot configured for receiving the contact pins therein. At least one of the walls has a first notch for receiving the first contact pin therein. The lamp holder also includes an electrically conductive terminal associated with the slot for providing power to the second contact pin. The terminal is configured for melting when being an electrode of an electric arc discharge, thereby discontinuing the electric arc discharge. The lamp holder further includes an electrically conductive resilient device for biasing the contact pins out of the slot when the first contact pin is not received in the first notch and for biasing the first contact pin into the first notch when the first contact pin is received in the first notch. The resilient device is biased against the terminal by the second contact pin when the first contact pin is received in the first notch. The resilient device interconnects the terminal and the second contact pin when the first contact pin is received in the first notch.

2 Claims, 2 Drawing Sheets

FLUORESCENT LAMP HOLDER

CROSS REFERENCE TO RELATED APPLICATIONS

This is a continuation-in-part of U.S. patent application Ser. No. 08/551,897 now U.S. Pat. No. 5,688,139, by the same title, filed Oct. 23, 1995.

BACKGROUND OF THE INVENTION

1. Field of the Invention

The present invention relates to lamp sockets, and, more particularly, to fluorescent lamp sockets.

2. Description of the Related Art

Fluorescent lamps, as known, include a glass tube coated on the inside with phosphor powders which fluoresce when excited by ultraviolet light. The glass tube is filled with rare gases (such as argon, neon, and krypton) and a small amount of mercury, and operates at a relatively low pressure. Electrodes are mounted within the glass tube and emit electrons during operation. The electrons are accelerated by the voltage across the tube until they collide with mercury atoms, causing the mercury atoms to be ionized and excited. When the mercury atoms return to their normal state, photons corresponding to mercury spectral lines in both the visible and ultraviolet region are generated, thereby exciting the phosphor coating on the inside of the tube to luminance.

To start a fluorescent lamp, electron emission from the electrodes may be induced in one of two ways. First, a filament electrode may be heated by passing current therethrough. Secondly, a high voltage which is sufficient to start an electric discharge in the lamp may be applied across the lamp without preheating the electrodes. Instant start circuits which are commonly used today typically employ the latter method of inducing electron emission from the electrodes. Instant start circuits use a ballast which applies a high voltage (e.g., up to 848 VAC) at a high frequency. Such instant start ballasts are much more energy efficient than older style ballasts which heat the electrodes.

A problem associated with fluorescent lamps utilizing an instant start ballast is that the high voltage applied to the electrodes by the ballast can also cause electrical arcing to occur between a contact pin of the fluorescent lamp and the conductor of the fluorescent lamp holder in which the fluorescent lamp is installed. For example, known fluorescent lamp holders may include slots for receiving the two respective contact pins of the fluorescent lamp therein. However, with conventional designs, if the contact pins are not correctly inserted into the socket, it is possible for one of the contact pins to be fully disengaged with the conductor, with the other contact pin being disposed a small distance away from the conductor (e.g., 0.030 inch). Alternatively, it is possible for each of the contact pins to be disposed a small distance away from the conductor (e.g., 0.030 inch). In either event, the high voltage applied to the contact pins by the instant start ballast may result in electrical arcing between the conductor and the contact pin disposed the small distance therefrom. Such electrical arcing is clearly not desirable.

Similarly, with fluorescent lamps utilizing a rapid start ballast, a two-piece conductor is used to contact each respective contact pin. It is possible for one of the contact pins to be fully engaged with the conductor, while the other contact pin is disposed a small distance away from the conductor (e.g., 0.030 inch). Under such conditions, the high voltage applied to the conductor (e.g., 220 VAC) may result in electrical arcing between the conductor and contact pins.

What is needed in the art is a fluorescent lamp holder which prevents electrical arcing between a conductor of the lamp holder and the contact pins of a fluorescent lamp.

SUMMARY OF THE INVENTION

The present invention provides a lamp holder for a fluorescent lamp which prevents electrical arcing between a fluorescent tube conductor of the lamp holder and the contact pins of a fluorescent lamp.

The invention comprises, in one form thereof, a lamp holder carrying a fluorescent lamp which includes first and second contact pins, with each contact pin having a diameter. The lamp holder includes a socket having a pair of walls defining a clearance distance therebetween which is at all times greater than the diameter of the contact pins. The walls define a slot therebetween, the slot configured for receiving the contact pins therein. At least one of the walls has a first notch for receiving the first contact pin therein. The lamp holder also includes an electrically conductive terminal associated with the slot for providing power to the second contact pin. The terminal is configured for melting when being an electrode of an electric arc discharge, thereby discontinuing the electric arc discharge. The lamp holder further includes an electrically conductive resilient device for biasing the contact pins out of the slot when the first contact pin is not received in the first notch and for biasing the first contact pin into the first notch when the first contact pin is received in the first notch. The resilient device is biased against the terminal by the second contact pin when the first contact pin is received in the first notch. The resilient device interconnects the terminal and the second contact pin when the first contact pin is received in the first notch.

An advantage of the present invention is that electrical arcing between the contact pins of the fluorescent lamp and the lamp holder is prevented. A clearance distance of greater than the diameter of the fluorescent tube contact pins is formed within a slot of the lamp holder for the contact pins to pass through freely. The tube is partially ejected from the socket if not positively seated.

Another advantage is that electrical arcing between the contact pins of the fluorescent lamp and the lamp holder is prevented, while at the same time allowing single-handed installation of the fluorescent lamp within the lamp holder.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
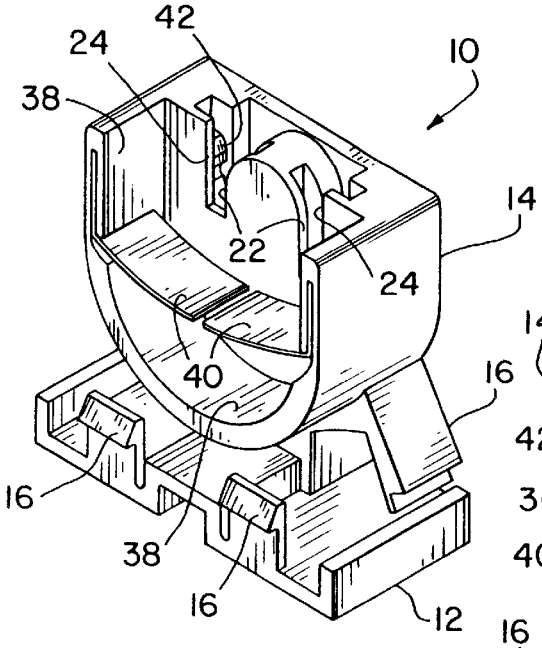
FIG. 1 is a perspective view of an embodiment of a fluorescent lamp holder of the present invention.
Figure 2:
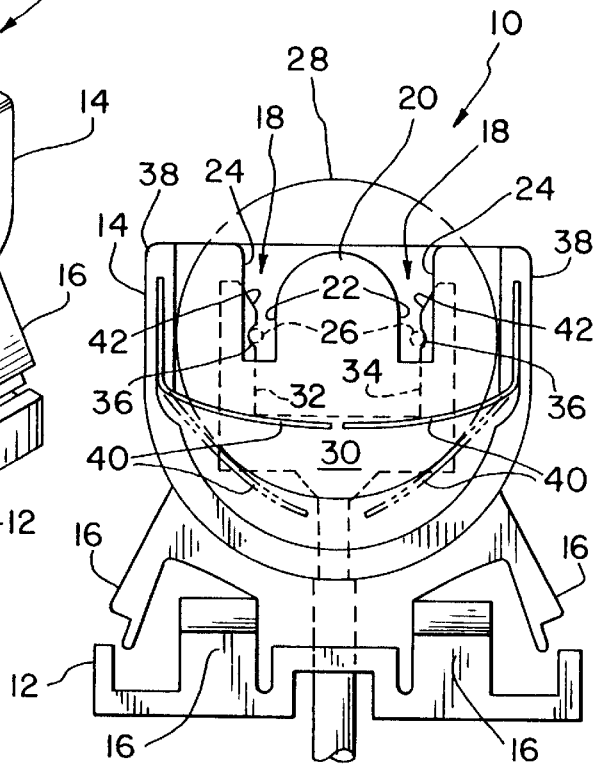
FIG. 2 is a front view of the fluorescent lamp holder shown in FIG. 1.
Figure 3:
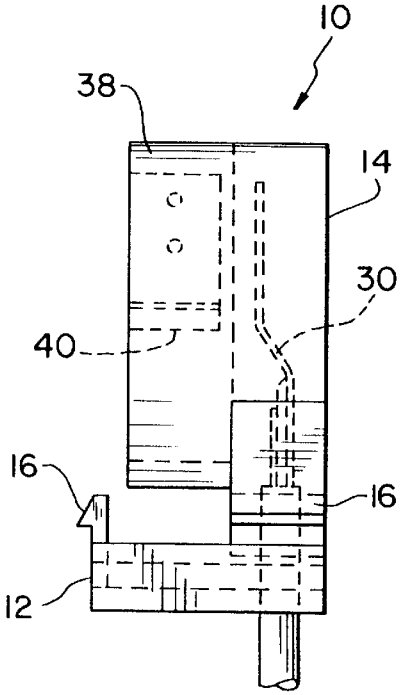
FIG. 3 is a side view of the fluorescent lamp holder shown in FIGS. 1 and 2.

Referring now to the drawings and particularly to FIGS. 1–3, an embodiment of a lamp holder assembly including a fluorescent lamp holder 10 of the present invention is shown. Lamp holder 10 generally includes a base 12 and socket 14.

Base 12 is configured for attachment to a housing of a fluorescent lamp fixture (not shown). In the embodiment shown, base 12 includes resilient clamps 16 which provide for snap fitting engagement with the housing of the fluorescent lamp fixture.

Socket 14 includes two parallel slots 18 disposed on opposite sides of an inner hub 20. Slots 18 are defined by respective pairs of parallel walls 22, 24. Slots 18 are configured for receiving respective contact pins 26 of a fluorescent lamp 28 (shown in phantom lines in FIG. 2) therein.

A conductor 30 is of one-piece construction and is disposed within socket 14. Such a one-piece conductor may be used with an instant start ballast. Conductor 30 includes a first contact portion 32 associated with one of slots 18, and a second contact portion 34 associated with the other of slots 18. Each of first and second contact portions 32 and 34 have a notch 36 therein which is configured to receive and directly engage a corresponding contact pin 26. Notches 36 are each disposed adjacent to an associated parallel wall 24, and away from an associated parallel wall 22. Thus, first and second contact portions 32 and 34 are disposed on a side of a respective slot 18 which is generally opposite from inner hub 20. In the embodiment shown in FIGS. 1–3, parallel walls 22 are defined by inner hub 20.

In the embodiment shown in FIGS. 1–3, notches 36 are formed on conductor 30 by cutting out a portion of first and second contact portions 32 and 34. However, it is also to be understood that first and second contact portions 32 and 34 could be bent or formed to define notches 36.

First and second contact portions 32 and 34, together with parallel walls 22 of inner hub 20, define a clearance distance (not numbered) therebetween which is at all times greater than the diameter of contact pins 26. The clearance distance is measured in a direction transverse to a longitudinal direction of slots 18 (e.g., perpendicular to parallel walls 22), and allows contact pins 26 to be moved away from conductor 30 by a spring mechanism discussed below, when one of contact pins 26 is not received within a corresponding notch 36. That is, the clearance distance between first and second contact portions 32 and 34 and an associated parallel wall 22 is greater than the diameter of contact pins 26 regardless of whether contact pins 26 are engaged or disengaged with notches 36 of conductor 30.

In the embodiments shown in FIGS. 1–3, the clearance distance between first and second contact portions 32 and 34 and associated parallel wall 22 is the same. However, it is also to be understood that the clearance distance does not have to necessarily be the same, as long as contact pin 26 is free to pass between the first or second contact portions 32, 34 and the inner hub at all times, when one of the contact pins 26 is not engaged within an associated notch 36. The clearance distance allows fluorescent lamp 28 and contact pins 26 to be biased away from conductor 30, whereby arcing between contact pins 26 and conductor 30 is prevented.

Socket 14 also includes an axially projecting flange 38 which is attached to and carries resilient springs 40. Springs 40, which in the embodiments shown are in the form of leaf springs, bias contact pins 26 out of slots 18. More particularly, when fluorescent lamp 28 is in an installed position within socket 10 as shown in FIG. 2, springs 40 are deflected by fluorescent lamp 28 to the position shown in phantom lines in FIG. 2. Springs 40 thus exert a force on fluorescent lamp 28, and thereby also exert a force on contact pins 26 in a direction out of slots 18.

In use, fluorescent lamp 28 is aligned relative to lamp holder 10 such that contact pins 26 are received within slots 18. Contact pins 26 engage a beveled edge 42 and deflect first and second contact portions 32, 34, thereby allowing contact pins 26 to be received within and directly engaged by notches 36. As fluorescent lamp 28 is received within lamp holder 10, fluorescent lamp 28 biases springs 40 to the position shown in phantom lines in FIG. 2. When each contact pin 26 is received within a corresponding notch 36 of conductor 30, the force exerted on lamp 28 by springs 40 is not sufficient to dislodge contact pins 26 from notches 36. However, if one of the contact pins 26 becomes disengaged with an associated notch 36, springs 40 bias both of contact pins 26 to move contact pins 26 out of slots 18 and thereby prevent electrical arcing between contact pins 26 and conductor 30 regardless of mounting position. The clearance distance between first and second contact portions 32, 34 and inner hub 20 is sufficient to allow each of contact pins 26 to be moved out of the respective slots 18 and tube 28 partially out of socket 14 when one of contact pins 26 becomes disengaged with an associated notch 36.

In the embodiment shown in FIGS. 1–3, socket 14 is provided with parallel slots 18. However, it is also to be understood that socket 14 may include slots which are disposed other than parallel to each other. For example, socket 14 may include one or more slots disposed in communication with each other which will allow the fluorescent lamp to be inserted therein and twisted into position such that the contact pins engage the conductor. A necessary criterion with other slots that may be formed in socket 14 is that the contact pins must be free to be moved away from the conductor if one of the pins becomes disengaged from the conductor, thereby preventing arcing therebetween.

Figure 4:
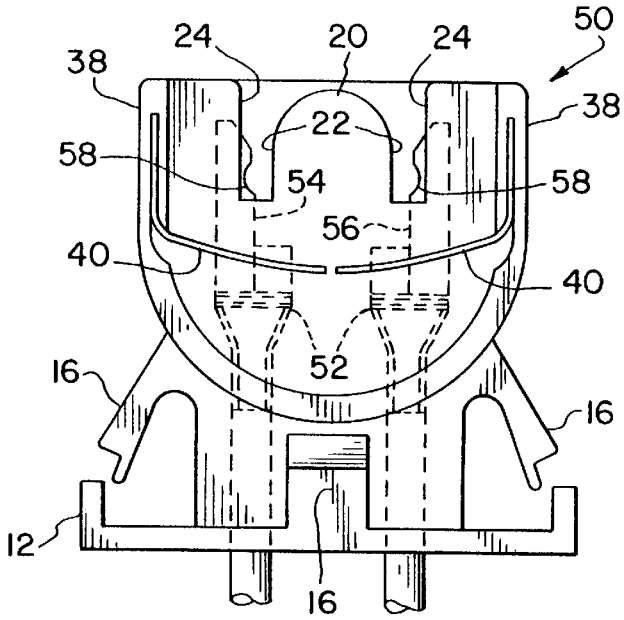
FIG. 4 is a front view of another embodiment of a fluorescent lamp holder of the present invention.
Figure 6:
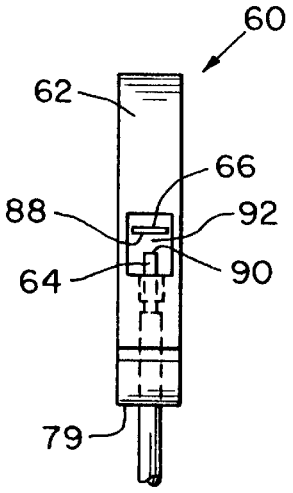
FIG. 6 is a side view of the fluorescent lamp holder shown in FIG. 5.

Referring now to FIG. 4, another embodiment of a fluorescent lamp holder 50 of the present invention is shown. Lamp holder 50 is similar to lamp holder 10 shown in FIGS. 1–3. However, conductor 52 is of two-piece construction, and includes a first contact portion 54 and a second contact portion 56. Such a two-piece conductor is typically used with a rapid start ballast. First and second contact portions 54, 56 include respective notches 58 for receiving and engaging the contact pins of a fluorescent lamp therein. In other respects, lamp holder 50 is generally the same as lamp holder 10 shown in FIGS. 1–3, with a similar method of use. Accordingly, common reference numbers are used for parts which are generally the same in the embodiment shown in FIGS. 1–3 and in the embodiment shown in FIG. 4.

Referring now to FIGS. 5–9, another embodiment of a fluorescent lamp holder 60 of the present invention is shown. Fluorescent lamp holder 60 includes a socket 62, electrically conductive terminal 64 and resilient spring 66.

Socket 62 includes a slot 68 defined by a pair of opposing interior walls 70 and an end wall 71 interconnecting walls 70. Slot 68 is configured for receiving a first contact pin 72 (FIGS. 7–9) and a second contact pin 74 of fluorescent lamp 28 therein. Each wall 70 has a first notch 76 and a second notch 78 therein configured to receive and directly engage first and second contact pins 72 and 74, respectively. Second contact pin 74 is defined as the leading one of the two contact pins of fluorescent lamp 28 as inserted into slot 68 by the installer, while first contact pin 72 is the trailing one of the two contact pins. Notches 76 and 78 are shown as slanting upward from slot 68 for reasons that will become evident. Socket 62 can be formed of plastic or any other suitable non-conductive material.

Walls 70 define a clearance distance (not numbered) therebetween which is at all times greater than the diameter of contact pins 72 and 74. The clearance distance is measured in a direction transverse to a longitudinal direction of slot 68 (i.e., generally transverse to walls 70), and allows contact pins 72 and 74 to be moved away from electrically conductive terminal 64 by resilient spring 66 when first contact pin 72 is not received within a first notch 76. That is, the clearance distance between walls 70 is greater than the diameter of contact pins 72 and 74 regardless of whether contact pins 72 and 74 are engaged or disengaged with notches 76 and 78 of walls 70. The clearance distance allows fluorescent lamp 28 and contact pins 72 and 74 to be biased away from electrically conductive terminal 64, whereby arcing between resilient spring 66 and terminal 64 is prevented.

Figure 5:
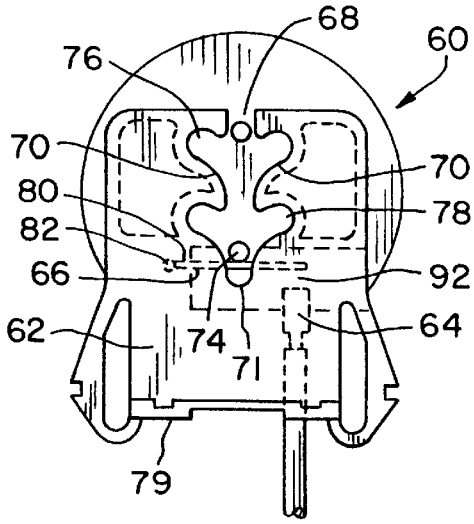
FIG. 5 is a front view of yet another embodiment of a fluorescent lamp holder of the present invention with the contact pins of a fluorescent lamp inserted therein.
Figure 7:
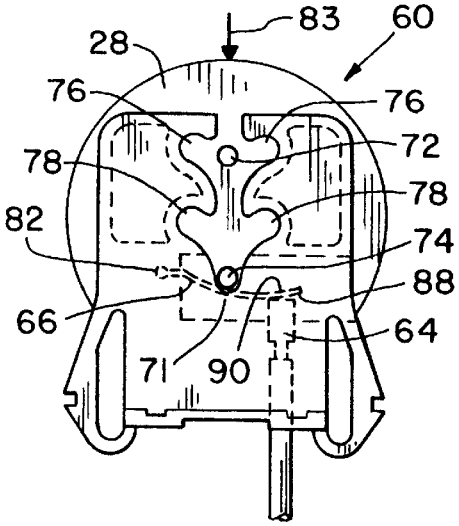
FIG. 7 is a front view of the fluorescent lamp holder shown in FIGS. 5 and 6 with the contact pins of the fluorescent lamp inserted therein and slightly depressed.

Resilient spring 66 in the embodiments shown is in the form of a substantially straight leaf spring having a proximal end 80 rigidly connected to socket 62 at point of attachment 82. Spring 66 is formed of a fairly rigid electrically conductive material which is not readily weldable to surrounding metal components, such as terminal 64, even when exposed to high temperature. For example, spring 66 may be formed from stainless steel and terminal 64 may be formed from brass such that spring 66 is substantially not weldable to terminal 64. When no force is applied, spring 66 extends closely adjacent to end wall 71, in a direction substantially transverse to a longitudinal direction of slot 68, as shown in FIG. 5. In use, however, spring 66 is deflected by second contact pin 74 and exerts a counteracting force on contact pin 74. More particularly, when an installer inserts pins 72 and 74 into slot 68 and applies a force to fluorescent lamp 28, as indicated by the arrow 83 in FIG. 7, second contact pin 74 "bottoms out" at end wall 71 and deflects spring 66 as shown. If the installer releases the force applied to lamp 28 before placing first contact pin 72 in one of first notches 76 by rotating tube 28, spring 66 will exert a force on second contact pin 74 and, through lamp 28, on first contact pin 72 in a direction out of slot 68. In such a situation, second contact pin 74 can become latched in one of second notches 78, preventing lamp 28 from becoming completely disengaged from lamp holder 60. This is especially desirable since lamp holder 60 is often mounted in an orientation rotated, e.g., 90° or 120° from that shown in the figures. That is, the base 79 of lamp holder 60 may be attached to a wall with slot 68 opening away from the wall. The latching of second contact pin 74 into one of second notches 78, or even into one of first notches 76, can save lamp 28 from falling to the floor and quite probably breaking.

Figure 8:
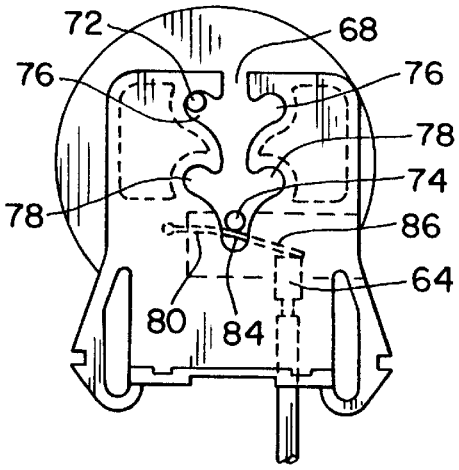
FIG. 8 is another front view of the fluorescent lamp holder and fluorescent lamp shown in FIG. 7 with one of the contact pins of the fluorescent lamp disposed within a notch of the lamp holder.
Figure 9:
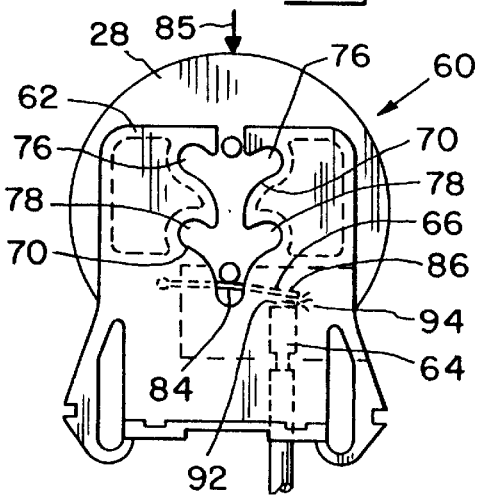
FIG. 9 is yet another front view of the fluorescent lamp holder and fluorescent lamp shown in FIGS. 7 and 8 with one of the contact pins shown deflecting the resilient spring.

If the installer does latch first contact pin 72 in one of first notches 76 by first rotating and then releasing tube 28, tube 28 will be secured within lamp holder 60 as shown in FIG. 8. Spring 66 biases first contact pin 72 into first notch 76 through the force it exerts upon second contact pin 74 and tube 28. Second contact pin 74, in response, biases spring 66 against terminal 64 such that spring 66 electrically interconnects second contact pin 74 and terminal 64. More particularly, second contact pin 74 deflects a central point 84 of spring 66, causing an arching of proximal end 80 of spring 66, shown to the left of central point 84 in FIG. 8. A distal end 86 of spring 66, shown to the right of central point 84, extends in a substantially straight path from central point 84 toward terminal 64, finally contacting terminal 64. Distal end 86 of spring 66 has a contact surface 88 which forms an electrical interconnection with terminal 64.

Electrically conductive terminal 64 is connected to an electrical power source (not shown) and supplies power to second contact pin 74 through electrically conductive resilient spring 66. Terminal 64 is fabricated of an electrically conductive substance, such as, for example, brass. Contact surface 90 of terminal 64 forms an electrical interconnection with contact surface 88 of spring 66. Terminal 64 is shown in the form of a blade, however, it is to be understood that terminal 64 can suitably have any of a variety of shapes and forms.

It is possible that second contact pin 74 is physically touching spring 66, yet spring 66 has not been significantly deflected toward terminal 64, as shown in FIG. 5. This can result from first contact pin 72 not being properly seated within a first notch 76. In this case, gap 92 between spring 66 and terminal 64 is of such dimension that electrical arcing cannot occur between spring 66 and terminal 64.

It may also be possible that spring 66 is only partially deflected by second contact pin 74 such that gap 92 is not completely closed and contact surface 88 of spring 66 does not quite make contact with contact surface 90 of terminal 64. This can result from some malfunction or deterioration of spring 66, or can momentarily occur during installation of lamp 28 in lamp holder 60. An electric arc discharge can develop between spring 66 and terminal 64 in such a situation when power is being supplied to terminal 64. In the case illustrated in FIG. 9, a force exerted on lamp 28, as indicated by the arrow 85, causes second contact pin 74 to deflect spring 66 to a degree that arcing does occur, as indicated at 94, between contact surface 88 of spring 66 and contact surface 90 of terminal 64. Terminal 64 is formed in such a manner that terminal 64 will melt after a predetermined amount of time, e.g., approximately 30 continuous seconds, of being an electrode in an electric arc discharge, such as described above. By virtue of this melting, or "sacrificing," of terminal 64, the evident dangers associated with electrical arcing are alleviated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lamp holder for carrying a fluorescent lamp, the fluorescent lamp including at least a first contact pin and a second contact pin, each contact pin having a diameter, said lamp holder comprising:

a socket including a pair of walls defining a slot with a clearance distance between said walls which is at all times greater than the diameter of each of the contact pins, said slot configured for receiving at least one contact pin therein;

an electrical conductor at least partly disposed within the slot, said conductor or said walls including a notch for receiving the first contact pin therein, said conductor electrically connected to the second contact pin when the first contact pin is received in said notch;

retaining means for biasing the first contact pin into said notch and thereby retaining the first contact pin within said notch; and biasing means for biasing the first contact pin out of said slot when the first contact pin is not received in said notch, said biasing means being configured to be in biasing contact only with the second contact pin, whereby electrical arc discharging with said conductor is prevented.

2. The lamp holder of claim 1, wherein said retaining means is configured for exerting a force on the one contact pin at least in part in a direction generally transverse to said walls.

* * * * *